US006360403B1

(12) United States Patent
Rübenach

(10) Patent No.: US 6,360,403 B1
(45) Date of Patent: Mar. 26, 2002

(54) FIBER MATERIAL FEEDER HAVING A SPIKED LATTICE

(75) Inventor: Bernhard Rübenach, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 09/940,477

(22) Filed: Aug. 29, 2001

(30) Foreign Application Priority Data

Sep. 2, 2000 (DE) ..... 100 43 338

(51) Int. Cl.[7] ..... D01B 1/00
(52) U.S. Cl. ..... 19/97.5; 19/105; 19/205
(58) Field of Search ..... 19/65 A, 97.5, 19/105, 145.5, 145.7, 200, 204, 205, 296, 300; 198/550.01, 550.04, 550.05, 550.08; 209/245, 247; 222/56, 64, 271, 274, 282; 414/278

(56) References Cited

U.S. PATENT DOCUMENTS 528,389 A * 10/1894 Potter ..... 19/97.5
3,738,476 A * 6/1973 Hullett et al. ..... 198/550.8
4,987,646 A * 1/1991 Leifeld et al. ..... 19/97.5
4,993,119 A * 2/1991 Roberson ..... 19/105
5,044,046 A * 9/1991 Pinto et al. ..... 19/205
5,072,491 A * 12/1991 Pinto et al. ..... 19/105
5,297,316 A * 3/1994 Bernhardt et al. ..... 19/105

* cited by examiner

*Primary Examiner*—John J. Calvert
*Assistant Examiner*—Gary L. Welch
(74) *Attorney, Agent, or Firm*—Venable; Gabor J. Kelemen

(57) ABSTRACT

A fiber material feeder includes a spiked lattice which has an upper and a lower end roller each having a longitudinal axis. The spiked lattice has an inclined, endless belt supported on the end rollers and a plurality of spikes carried at the outer belt surface and forming a series of consecutive rows extending along the belt width oriented parallel to the roller axes. The spike rows are oriented at an oblique inclination to the roller axes. Further, a drive is provided for circulating the endless belt about the end rollers for advancing fiber material, entrained by the spikes, upwardly toward the upper end roller. A scale including a weighing bin is provided for catching fiber material leaving the belt at the upper end roller.

16 Claims, 4 Drawing Sheets

FIBER MATERIAL FEEDER HAVING A SPIKED LATTICE

CROSS REFERENCE TO RELATED APPLICATION

This application claims the priority of German Application No. 100 43 338.3 filed Sep. 2, 2000, which is incorporated herein by reference.

BACKGROUND OF THE INVENTION

This invention relates to a fiber material feeder such as a weighing hopper feeder having a spiked lattice composed of an inclined endless belt which is supported by end rollers and which carries on its outer surface rows of spikes extending over the width of the carrier belt. The spiked lattice delivers fiber material to a weighing bin of a scale.

An exact metering of different fiber material components during fiber preparation is frequently performed by a weighing hopper feeder. As a rule, for each material component a separate weighing hopper feeder is provided. The transport of the material to the scale is preferably effected by a spiked lattice which has rows and columns of spikes which are oriented parallel to the axis of the end rollers of the spiked lattice. The circulating speed of the spiked lattice is varied as a function of the fiber mass in the weighing bin. The reason for such a speed variation is an exact metering at low circulating speeds just prior to reaching the desired weight in the weighing bin. Despite such a measure, the spiked lattice of conventional construction delivers the fiber material in batches to the combing station operating parallel with the spiked lattice. As a result, particularly at high outputs, weighing errors may occur since large, non-uniform fiber quantities may be carried by the spike rows.

SUMMARY OF THE INVENTION

It is an object of the invention to provide an improved fiber material feeder of the above-outlined type from which the discussed disadvantages are eliminated and which, in particular, makes possible a significant amelioration of the weighing accuracy with structurally simple means.

This object and others to become apparent as the specification progresses, are accomplished by the invention, according to which, briefly stated, the fiber material feeder includes a spiked lattice which has an upper and a lower end roller each having a longitudinal axis. The spiked lattice has an inclined, endless belt supported on the end rollers and a plurality of spikes carried at the outer belt surface and forming a series of consecutive rows extending along the belt width oriented parallel to the roller axes. The spike rows are oriented at an oblique inclination to the roller axes. Further, a drive is provided for circulating the endless belt about the end rollers for advancing fiber material, entrained by the spikes, upwardly toward the upper end roller. A scale including a weighing bin is provided for catching fiber material leaving the belt at the upper end roller.

A sudden, batch-like discharge of the entire fiber material quantity from the spike rows is avoided by arranging the spike rows at an inclination to the rotary axis of the end rolls supporting the belt of the spiked lattice. Thus, the duration of discharge of the fiber material carried on any spike row is lengthened, resulting in a significantly more accurate metering of the fiber material with which the weighing bin is charged. In particular, the invention has the advantage at high output speeds that the operational steps occur more rapidly and the charging rate of the weighing bin is increased.

DESCRIPTION OF THE PREFERRED EMBODIMENTS

Figure 1:
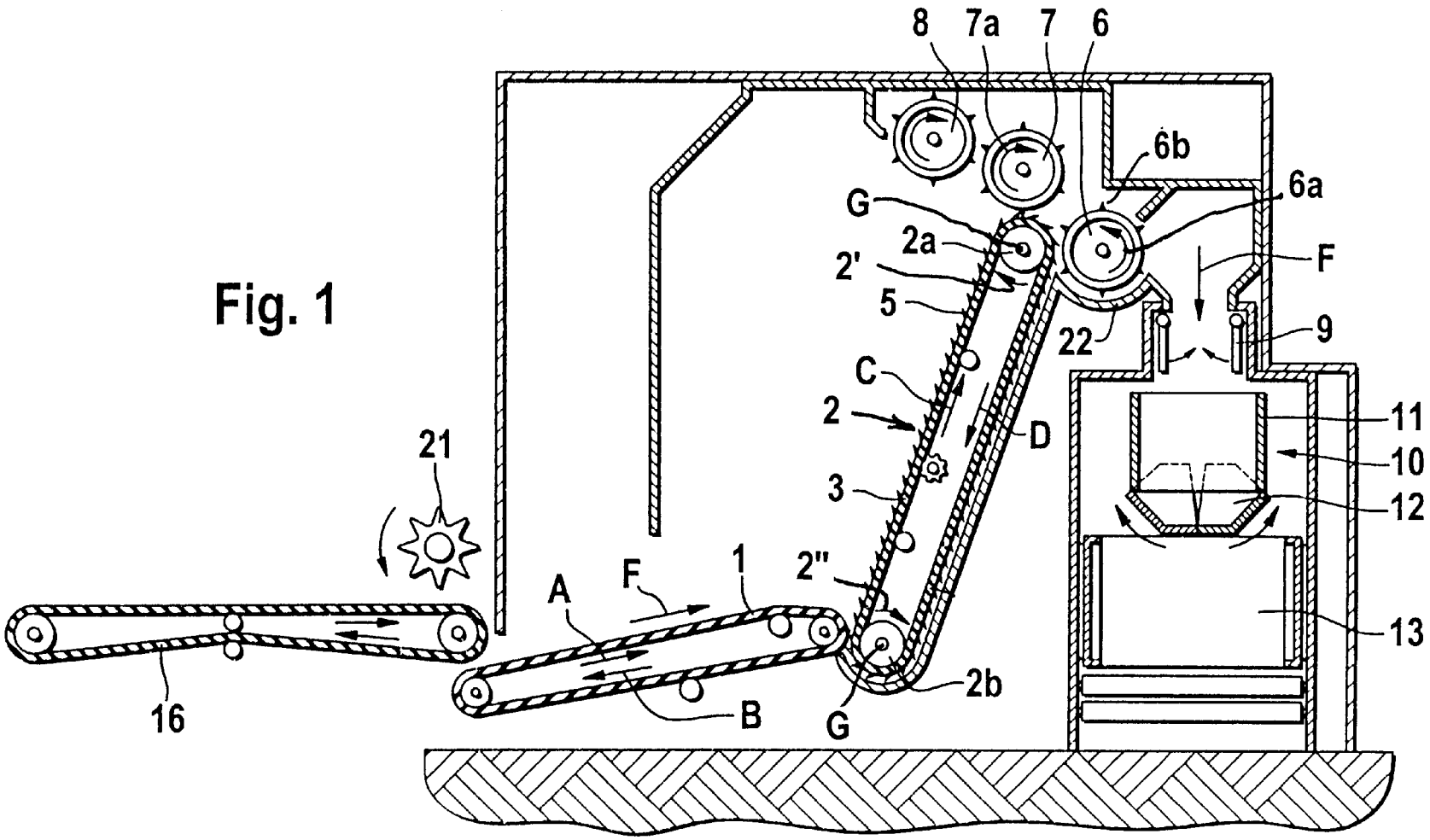
FIG. 1 is a schematic side elevational view of a weighing hopper feeder incorporating the invention.

FIG. 1 shows a weighing hopper feeder which may be a BOW-model manufactured by Trützschler GmbH & Co. KG, Mönchengladbach, Germany. The hopper feeder has a feeding table 16, a retaining roll 21 situated thereabove, an upwardly inclined feed lattice 1 constituted by an endless conveyor belt circulating in the direction A, B. The feed lattice 1 advances the fiber material symbolically designated at F to a spiked lattice 2 having an endless belt 3 provided with spikes 5. The belt 3 circulates in the direction C, D about belt-supporting end rollers 2*a*, 2*b* rotating about their respective longitudinal axis G in the direction of respective arrows 2', 2". The fiber material F is carried by the spikes 5 in the direction C to the upper end roller 2*a* which is adjoined by a stripping roll 6 whose direction of rotation 6*a* is opposite to the rotary direction 2' of the end roller 2*a*. A preliminary stripping roll pair 7, 8 immediately precedes the stripping roll 6. The spikes 6*b* of the stripping roll 6 remove the fiber material F from the spiked belt 2 and advance the fiber material F along a curved guide plate 22 in the direction of a charging chamber which may be closed by two shutoff gates 9. When the shutoff gates 9 are open the fiber material F falls into the weighing bin 11 of a scale 10. The lower outlet opening of the weighing bin 11 may be opened and closed by two bottom flaps 12. In the open position of the bottom flaps 12 the fiber material falls on a mixing table 13.

Figure 2:
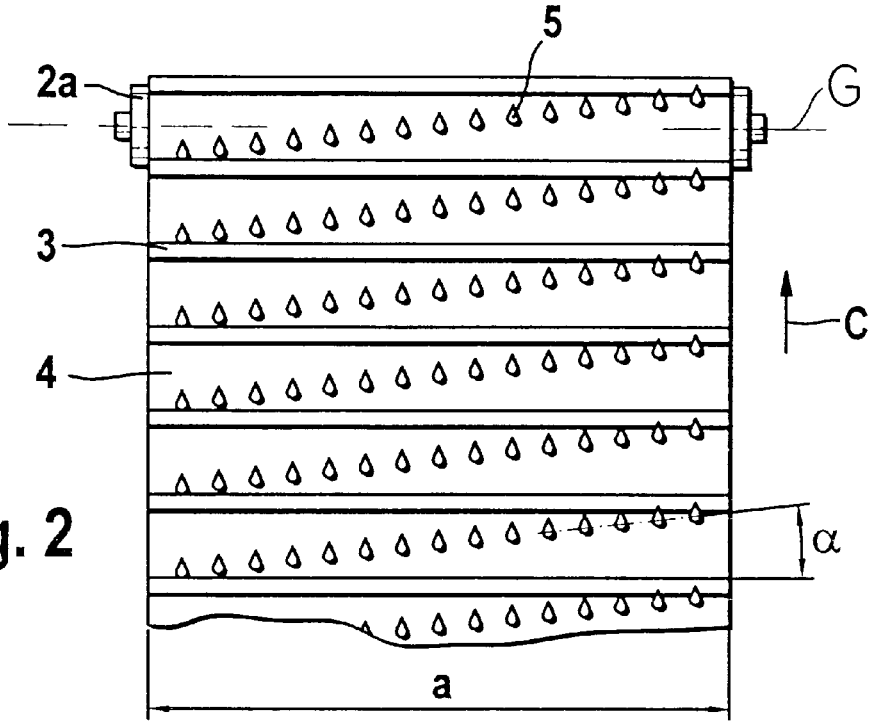
FIG. 2 is a fragmentary top plan view of a spiked lattice according to a preferred embodiment of the invention.
Figure 3:
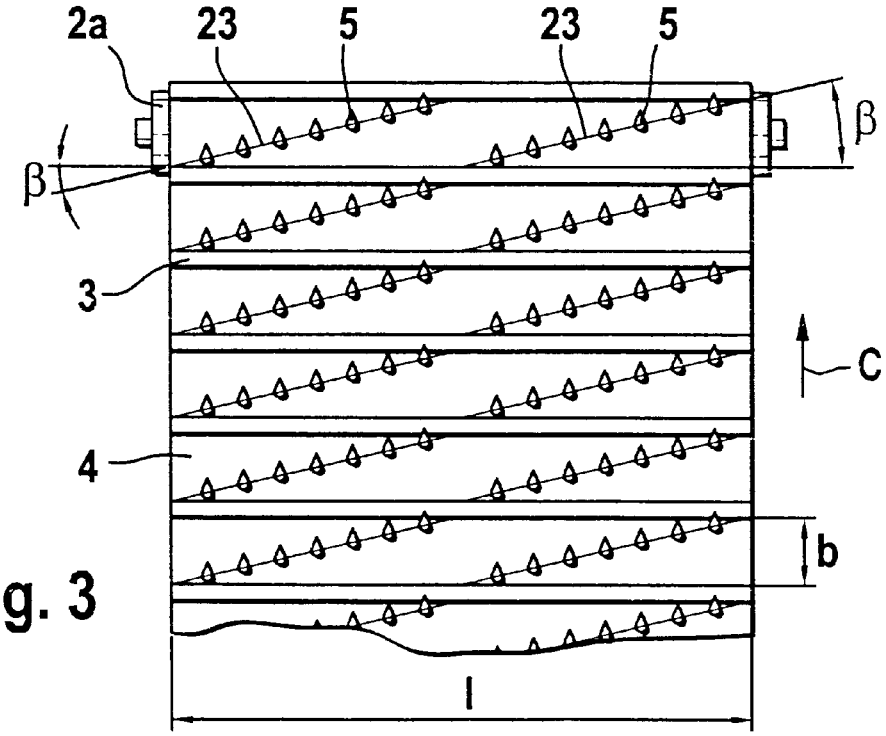
FIG. 3 is a fragmentary top plan view of a belt of a spiked lattice according to another preferred embodiment of the invention.

As shown in FIGS. 2 and 3, the belt 3 carries on its external face a series of spike boards 4 which extend parallel to the axial direction of the end rollers 2*a*, 2*b* and which have a length 1 of, for example, 1600 mm, corresponding to the belt width a. The width b of the spike boards 4 may be 50–100 mm. The spike boards 4 may be, for example, of wood or extruded aluminum.

In the embodiment shown in FIG. 2 the spikes 5 on each spike board 4 form a single straight row which extends substantially from one end of the board to the other and which is inclined at an angle $\alpha$ of 2°–4° to the horizontal rotary axes G of the end rollers 2*a* and 2*b*.

In the embodiment shown in FIG. 3, on each spike board 4 two parallel-spaced, offset, interrupted rows of spikes 5 are provided along imaginary row lines 23. The rows are oriented at an angle $\beta$ of 4°–15° to the rotary axes of the end rollers 2*a*, 2*b* and extend about 800 mm (about one half the belt width) in the width direction of the belt 3.

Figure 4A:
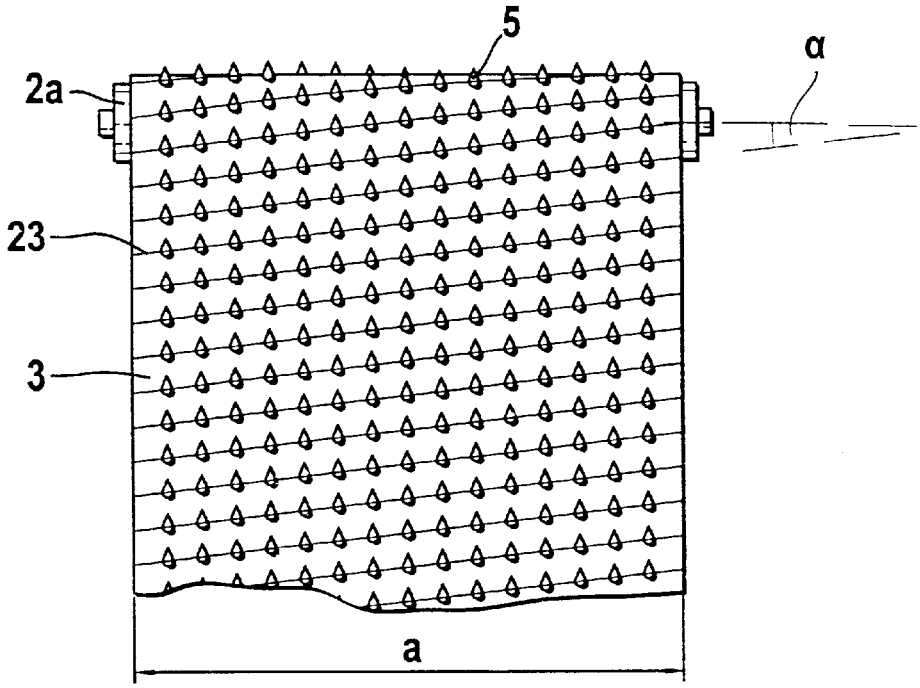
FIG. 4*a* is a fragmentary top plan view of a belt of a spiked lattice according to yet another preferred embodiment of the invention.

According to the embodiment shown in FIG. 4*a*, the spikes 5 are directly attached to the belt 3 in a plurality of rows which extend, along imaginary row lines 23, continuously throughout the width a of the belt 3 and which form an acute angle a with the rotary axis of the end rollers 2*a,* 2*b.*

Figure 4B:
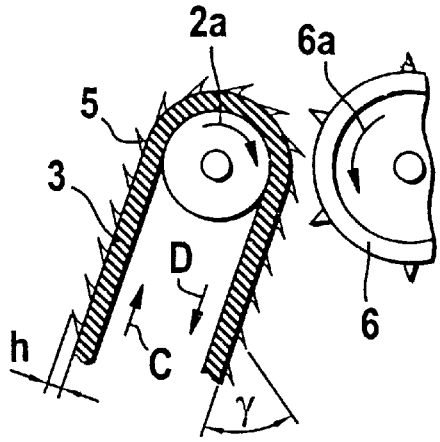
FIG. 4*b* is a fragmentary side elevational view of the structure illustrated in FIG. 4*a*.

As shown in FIG. 4*b,* each spike 5 is oriented at an angle γ forwardly with respect to the circulating direction C, D of the belt 3. The height h of the spike point from the upper surface of the belt 3 may be, for example, 25 mm.

Figure 5:
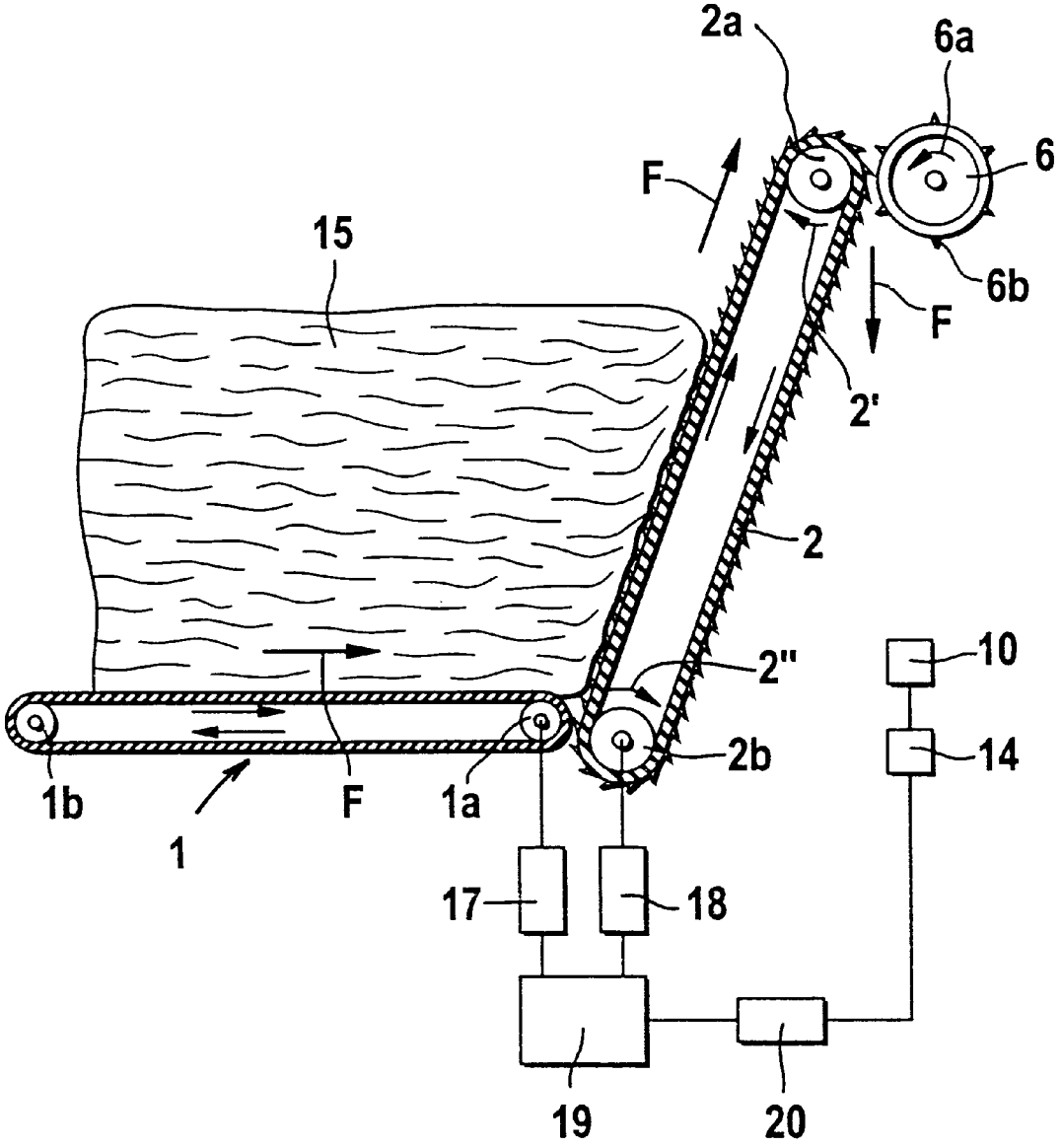
FIG. 5 is a schematic side elevational view of a spiked lattice type weighing bale opener showing a block diagram including an electronic control and regulating device.

As shown in FIG. 5, the feeding table 1 has end rollers 1*a* and 1*b*. The end roller 1*a* of the feeding table 1 and the end roller 2*b* of the spiked lattice 2 are connected to respective regulated drive motors 17 and 18 which, in turn, are coupled to an electronic control and regulating device 19 which controls the operating speed of the feeder apparatus. Further, a weight measuring element 14 of the scale 10 is connected via an evaluating device 20 to the control and regulating device 19. During fast operation the spiked lattice 2 circulates at a speed of, for example, 30–40 m/min. During slow advance when metering of the fiber material into the scale bin 11 takes place, the spiked lattice 2 has a speed of preferably less than 0.3 m/min.

By virtue of the inclined arrangement of the rows of the spikes 5 according to the invention, from each respective spike row only one part of the fiber material is taken off by the stripping roll 6, since at any given moment only a fraction of the spikes 5 in one spike row are exposed to the fiber-removing effect of the stripping roll 6. As a result, a fine metering during slow advance is significantly improved, since from each spike row at any given moment only a small portion of the fiber quantity carried by the spike row is introduced into the weighing bin 11 of the scale 10.

It will be understood that the above description of the present invention is susceptible to various modifications, changes and adaptations, and the same are intended to be comprehended within the meaning and range of equivalents of the appended claims.

What is claimed is:

1. A fiber material feeder comprising (a) a spiked lattice including (1) an upper and a lower end roller each having a longitudinal axis;

(2) an inclined, endless belt supported on said end rollers and having an outer surface and a width; said width extending parallel to the roller axes; and (3) a plurality of spikes carried at said outer surface and forming a series of consecutive rows extending along said width; said rows being oriented at an oblique inclination to said roller axes;

(b) drive means for circulating said endless belt about said end rollers for advancing fiber material, entrained by said spikes, upwardly toward said upper end roller; and (c) a scale including a weighing bin for catching fiber material leaving said belt at said upper end roller.

2. The fiber material feeder as defined in claim 1, wherein said spikes are directly secured to said belt.

3. The fiber material feeder as defined in claim 1, further comprising a plurality of boards secured to said belt in a series extending perpendicularly to said width; and further wherein said spikes are secured to said boards.

4. The fiber material feeder as defined in claim 1, further comprising a control and regulating device connected to said drive means for controlling a circulating speed of said spiked lattice.

5. The fiber material feeder as defined in claim 1, wherein said scale comprises a measuring element; further comprising a control and regulating device connected to said drive means for controlling a circulating speed of said spiked lattice and to said weight measuring element.

6. The fiber material feeder as defined in claim 1, wherein said width is approximately 1600 mm.

7. The fiber material feeder as defined in claim 1, wherein a length of said board measured parallel to said width is about 1600 mm.

8. The fiber material feeder as defined in claim 1, wherein said spikes are inclined at 45° to said outer surface in a direction said belt circulates.

9. The fiber material feeder as defined in claim 1, wherein each said row of spikes extends continuously substantially throughout said width.

10. The fiber material feeder as defined in claim 9, wherein said oblique inclination has an angle between 2° and 4°.

11. The fiber material feeder as defined in claim 1, wherein each said row of spikes extends discontinuously substantially throughout said width and is formed of two row parts staggered relative to one another in a direction perpendicular to said roller axes.

12. The fiber material feeder as defined in claim 11, wherein said oblique inclination has an angle between 4° and 15°.

13. The fiber material feeder as defined in claim 11, wherein said spike rows are discontinuous at about one half of said width.

14. The fiber material feeder as defined in claim 1, further comprising a stripping roll adjoining said upper end roller for removing fiber material from said belt.

15. The fiber material feeder as defined in claim 14, wherein said weighing bin has a charging opening; said stripping roll being positioned between said charging opening and said upper end roller.

16. The fiber material feeder as defined in claim 14, wherein said stripping roll is a first stripping roll; further comprising a second stripping roll adjoining said upper end roll and said first stripping roll for removing fiber material from said belt.

* * * * *